US006219504B1

(12) United States Patent
Matsuzaki et al.

(10) Patent No.: US 6,219,504 B1
(45) Date of Patent: Apr. 17, 2001

(54) PROCESS CARTRIDGE AND IMAGE FORMING APPARATUS

(75) Inventors: Hiroomi Matsuzaki, Mishima; Akira Suzuki, Odawara; Kazuo Chadani, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/401,650

(22) Filed: Sep. 23, 1999

(30) Foreign Application Priority Data

Sep. 24, 1998 (JP) ..... 10-287298

(51) Int. Cl.[7] ..... G03G 15/00
(52) U.S. Cl. ..... 399/92; 399/111
(58) Field of Search ..... 399/92, 91, 111, 399/107

(56) References Cited

U.S. PATENT DOCUMENTS 4,540,268 * 9/1985 Toyono et al. ..... 399/111 X
5,081,496 * 1/1992 Takeda ..... 399/92
5,612,768 * 3/1997 Kim et al. ..... 399/92
5,708,922 * 1/1998 Azuma et al. ..... 399/111
5,943,529 8/1999 Miyabe et al. ..... 399/111
5,966,567 10/1999 Matsuzaki et al. ..... 399/111
6,011,941 1/2000 Takashima et al. ..... 399/111

FOREIGN PATENT DOCUMENTS 2-253288 * 10/1990 (JP) .
4-156471 * 5/1992 (JP) .

* cited by examiner

*Primary Examiner*—Sophia S. Chen
(74) *Attorney, Agent, or Firm*—Fitzpatrick, Cella, Harper & Scinto

(57) ABSTRACT

The present invention solves problems caused by ozone within a process cartridge detachably mountable in a main body of an image forming apparatus. The process cartridge includes an electrophotographic photosensitive member, a charging device for charging the electrophotographic photosensitive member, frames for supporting the electrophotographic photosensitive member and the charging device, first holes for taking in air, provided at one end portion of the frames in the longitudinal direction and opened at a portion near one end portion of the charging device in the longitudinal direction, and second holes for discharging air, provided at another end portion of the opened at portion near another end portion of the charging device in the longitudinal direction.

17 Claims, 9 Drawing Sheets

PROCESS CARTRIDGE AND IMAGE FORMING APPARATUS

BACKGROUND OF THE INVENTION

1. Field of the Invention

The present invention relates to a process cartridge, and an electrophotographic image forming apparatus capable of detachably mounting the process cartridge.

The electrophographic image forming apparatus forms an image on a recording medium electrophotographic image forming process, and comprises, for example, an electrophotographic copier, an electrophotographic printer (such as an LED (light-emitting diode) printer, a laser-beam printer or the like), an electrophotographic facsimile apparatus, or an electrophographic word processor.

The process cartridge includes developing means or cleaning means, and charging means and an electrophotographic photosensitive member, which are integrated to form the cartridge so as to be detachably mountable in the main body of the electrophotographic image forming apparatus, or includes at least one of developing means and cleaning means, and charging means and an electrophotographic photosensitive member which are integrated to form the cartridge so as to be detachably mountable in the main body of the electrophotographic image forming apparatus, or includes at least charging means and an electrophotographic photosensitive member which are integrated to form the cartridge so as to be detachably moutable in the main body of the electrophotographic image forming apparatus.

2. Description of the Related Art

In conventional electrophotographic image forming apparatuses for forming an image on a recording medium using an electrophotographic image forming process, a process cartridge method is adopted in which an electrophotographic photosensitive member and process means operating thereon are integrated to form a process cartridge so as to be detachably mountable in the main body of the image forming apparatus. According to this process cartridge method, maintenance of the apparatus can be performed by the user himself without calling a serviceman, resulting in great improvement in the operability of the apparatus. Hence, the process cartridge method is widely being used in image forming apparatuses.

The process cartridge includes a cleaning unit provided by integrating charging means, cleaning means and a photosensitive drum, and a developing unit provided by integrating developing means and toner to be supplied thereto. The cleaning unit and the developing unit are connected by a connecting member in order to constitute the process cartridge.

The developing unit also includes a toner frame for accommodating the toner to be supplied to the developing means, and a developing frame for supporting the developing means. The toner frame and the developing frame are integrally fixed according to ultrasonic welding or the like.

SUMMARY OF THE INVENTION

It is an object of the present invention to provide a process cartridge and an electrophotographic image forming apparatus which prevents deformation of a frame and the adverse influence on toner and respective process means due to heat by discharging heat accumulated at a surrounding portion of an electrophotographic photosensitive member and within the process cartridge.

According to one aspect of the present invention, a process cartridge detachably mountable in a main body of an image forming apparatus includes an electrophotographic photosensitive member, charging means for charging the electrophotographic photosensitive member, frames for supporting the electrophotographic photosensitive member and the charging means, first holes for taking in air, provided at one end portion of the frames in the longitudinal direction and opened at a portion near one end portion of the charging means in the longitudinal direction, and second holes for discharging air, provided at another end portion of the frames in the longitudinal direction and opened at a portion near another end portion of the charging means in the longitudinal direction.

According to another aspect of the present invention, a process cartridge detachably mountable in a main body of an image forming apparatus includes an electrophotographic photosensitive member, charging means for charging the electrophotographic photosensitive member, frames for supporting the electrophotographic photosensitive member and the charging means, first holes for taking in air, provided at one end portion of the frames in the longitudinal direction so as to cross the longitudinal direction of the charging means, and second holes for discharging air, provided at another end portion of the frames in the longitudinal direction so as to be parallel to the longitudinal direction of the charging means.

According to still another aspect of the present invention, a process cartridge detachably mountable in a main body of an image forming apparatus includes an electrophotographic photosensitive member, charging means for charging the electrophotographic photosensitive member, developing means for developing a latent image formed on the electrophotographic photosensitive member using toner, a cartridge frame obtained by disposing the charging means in a space between a frame for supporting the electrophotographic photosensitive member and the charging means and a frame for supporting the developing means, and connecting the two frames, first holes for taking in air into the space, provided at one end portion of the cartridge frame in the longitudinal direction, and second holes for discharging air from the space, provided at another end portion of the cartridge frame in the longitudinal direction.

According to yet another aspect of the present invention, an electrophotographic image forming apparatus, capable of detachably mounting a process cartridge, for forming an image on a recording medium includes (a) a process cartridge including an electrophotographic photosensitive member, charging means for charging the electrophotographic photosensitive member, frames for supporting the electrophotographic photosensitive member and the charging means, first holes for taking in air, provided at one end portion of the frames in the longitudinal direction and opened at a portion near one end portion of the charging means in the longitudinal direction, and second holes for discharging air, provided at another end portion of the frames in the longitudinal direction and opened at a portion near another end portion of the charging means in the longitudinal direction, (b) mounting means for detachably mounting the process cartridge, (c) intake holes, communicating with the first holes, provided at an outer frame of a main body of the image forming apparatus facing the first holes of the process cartridge, in a state in which the process cartridge is mounted in the main body of the image forming apparatus, (d) discharge means for discharging air within the main body of the image forming apparatus communicating with the second holes of the process cartridge to the outside of the apparatus, in a state in which the process cartridge is mounted in the main body of the image forming apparatus, and (e) conveyance means for conveying the recording medium.

According to yet a further aspect of the present invention, an electrophotographic image forming apparatus, capable of detachably mounting a process cartridge, for forming an image on a recording medium includes (a) a process cartridge including an electrophotographic photosensitive member, charging means for charging the electrophotographic photosensitive member, frames for supporting the electrophotographic photosensitive member and the charging means, first holes for taking in air, provided at one end portion of the frames in the longitudinal direction so as to cross the longitudinal direction of the charging means, and second holes for discharging air, provided at another end portion of the frames in the longitudinal direction so as to be parallel to the longitudinal direction of the charging means, (b) mounting means for detachably mounting the process cartridge, (c) intake holes, communicating with the first holes, provided at an outer frame of a main body of the image forming apparatus facing the first holes of the process cartridge, in a state in which the process cartridge is mounted in the main body of the image forming apparatus, (d) discharge means for discharging air within the main body of the image forming apparatus communicating with the second holes of the process cartridge to the outside of the apparatus, in a state in which the process cartridge is mounted in the main body of the image forming apparatus, and (e) conveyance means for conveying the recording medium.

According to still another aspect of the present invention, an electrophotographic image forming apparatus, capable of detachably mounting a process cartridge, for forming an image on a recording medium includes (a) a process cartridge including an electrophotographic photosensitive member, charging means for charging the electrophotographic photosensitive member, developing means for developing a latent image formed on the electrophotographic photosensitive member using toner, a cartridge frame obtained by disposing the charging means in a space between a frame for supporting the electrophotographic photosensitive member and the charging means and a frame for supporting the developing means, and connecting the two frames, first holes for taking in air into the space, provided at one end portion of the cartridge frame in the longitudinal direction, and second holes for discharging air from the space, provided at another end portion of the cartridge frame in the longitudinal direction, (b) intake holes, communicating with the first holes, provided at an outer frame of a main body of the image forming apparatus facing the first holes of the process cartridge, in a state in which the process cartridge is mounted in the main body of the image forming apparatus, (c) discharge means for discharging air within the main body of the image forming apparatus communicating with the second holes of the process cartridge to the outside of the apparatus, in a state in which the process cartridge is mounted in the main body of the image forming apparatus, and (d) conveyance means for conveying the recording medium.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings. In the following description, the lateral direction of a process cartridge B indicates a direction of mounting/detaching the process cartridge B with respect a main body 14 of an apparatus, and coincides with the direction of conveying a recording medium. The longitudinal direction of the process cartridge B indicates a direction crossing (substantially orthogonal to) the direction of mounting/detaching the process cartridge B with respect to the main body 14 of the apparatus, and is crossing (substantially orthogonal to) the direction of conveying a recording medium.

Figure 1:
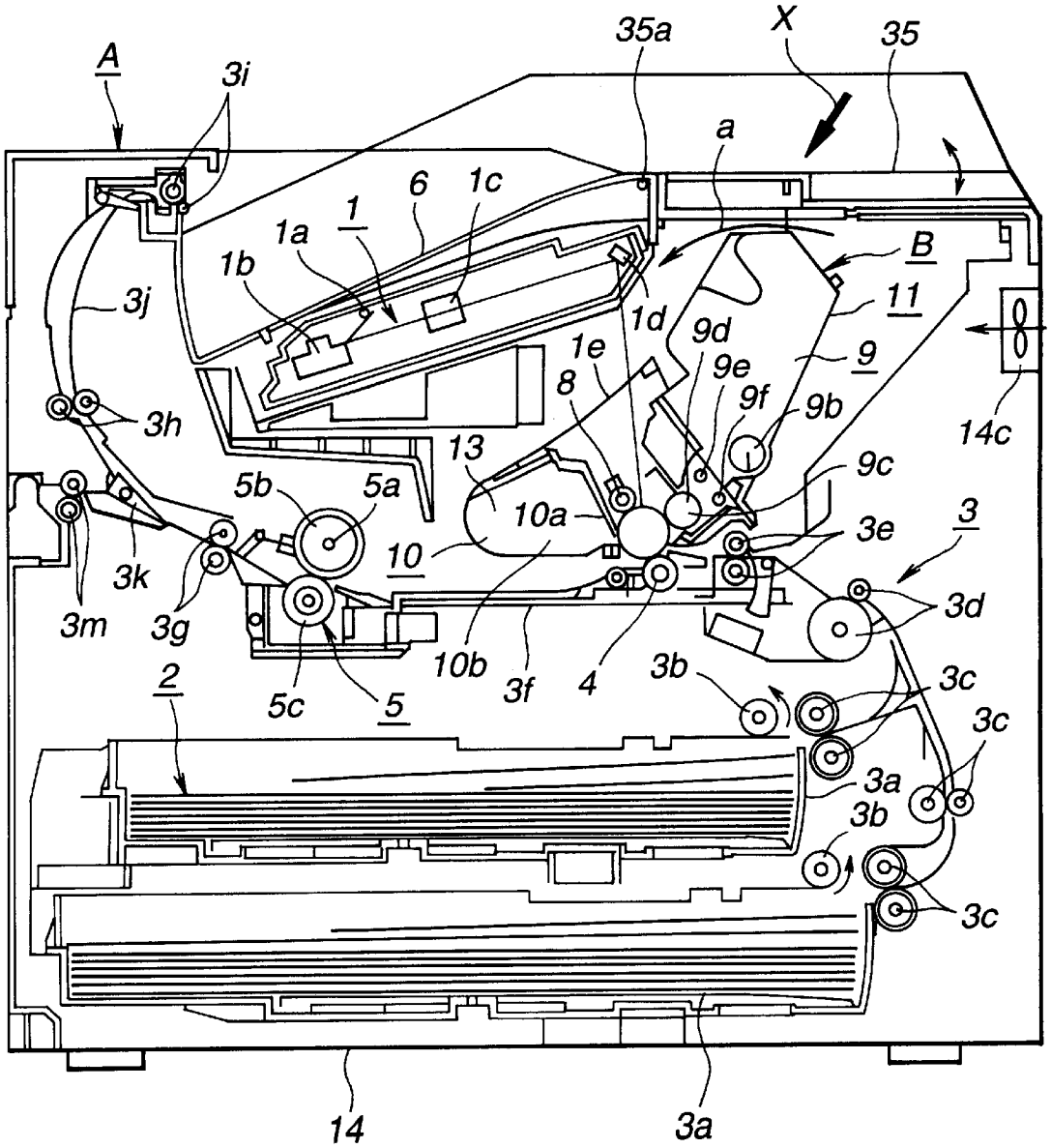
FIG. 1 is a side cross-sectional view illustrating an electrophotographic image forming apparatus according to an embodiment of the present invention.
Figure 2:
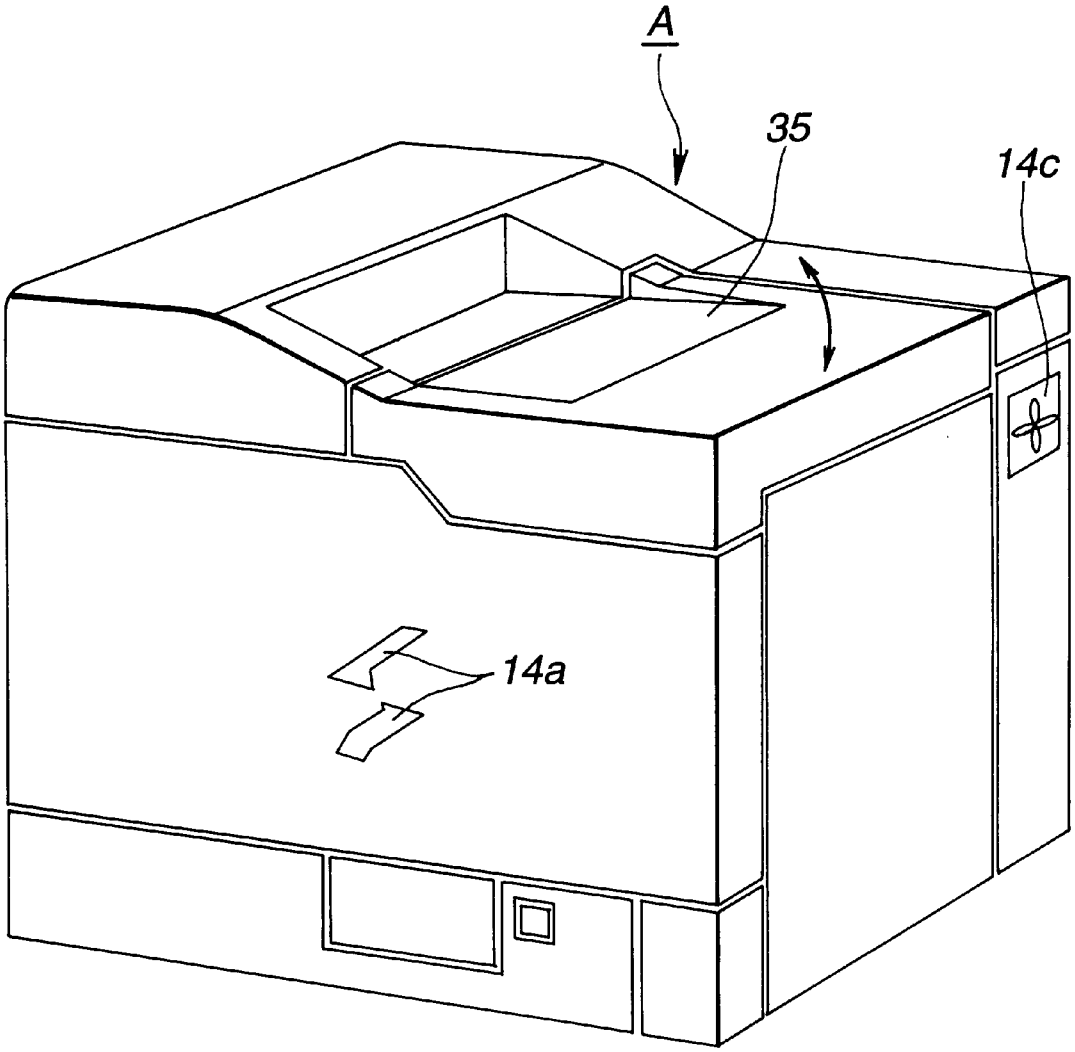
FIG. 2 is a perspective view illustrating an external appearance of the apparatus shown in FIG. 1.
Figure 3:
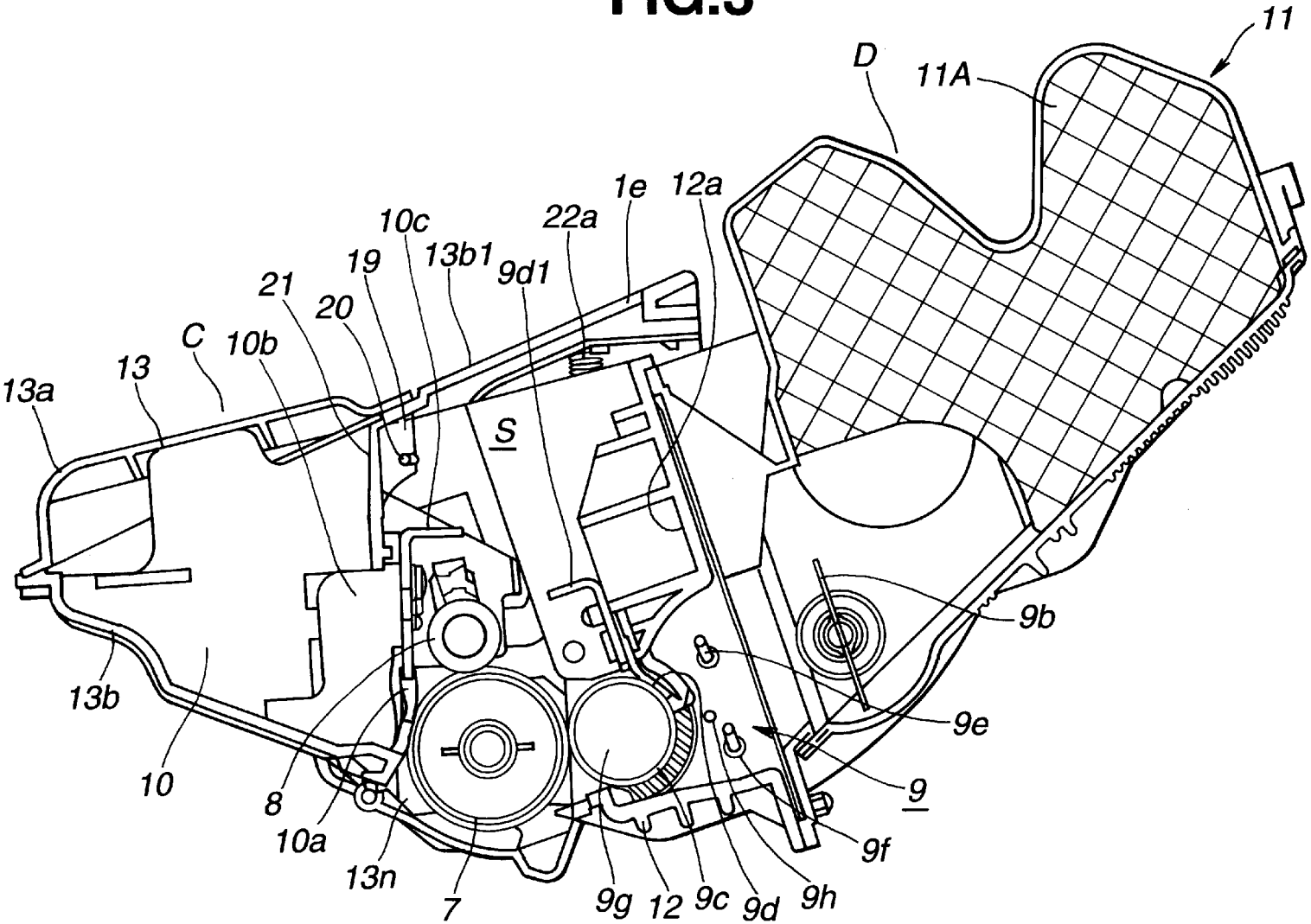
FIG. 3 is a side cross-sectional view illustrating a process cartridge shown in FIG. 1.
Figure 4:
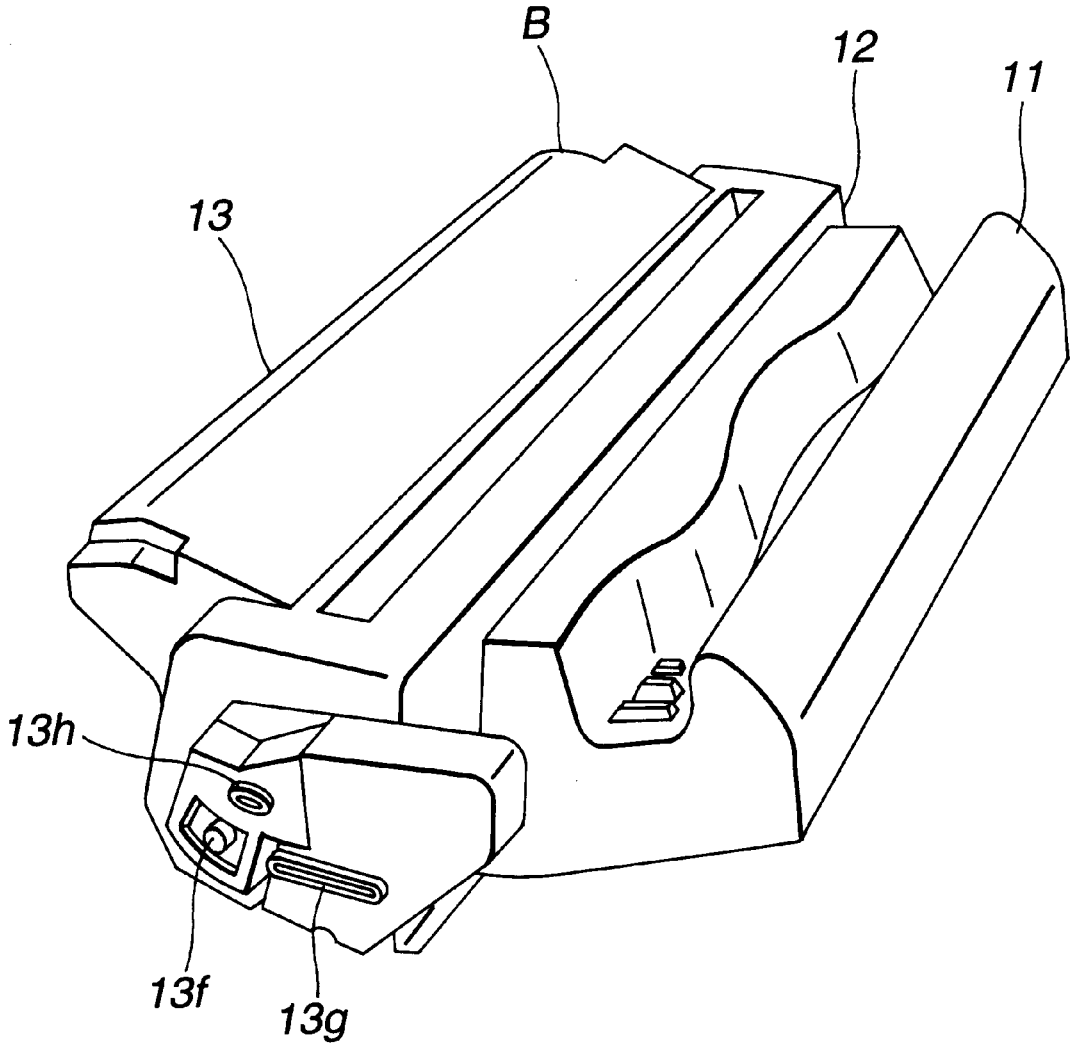
FIG. 4 is a schematic perspective view illustrating an external appearance of the process cartridge shown in FIG. 3.
Figure 5:
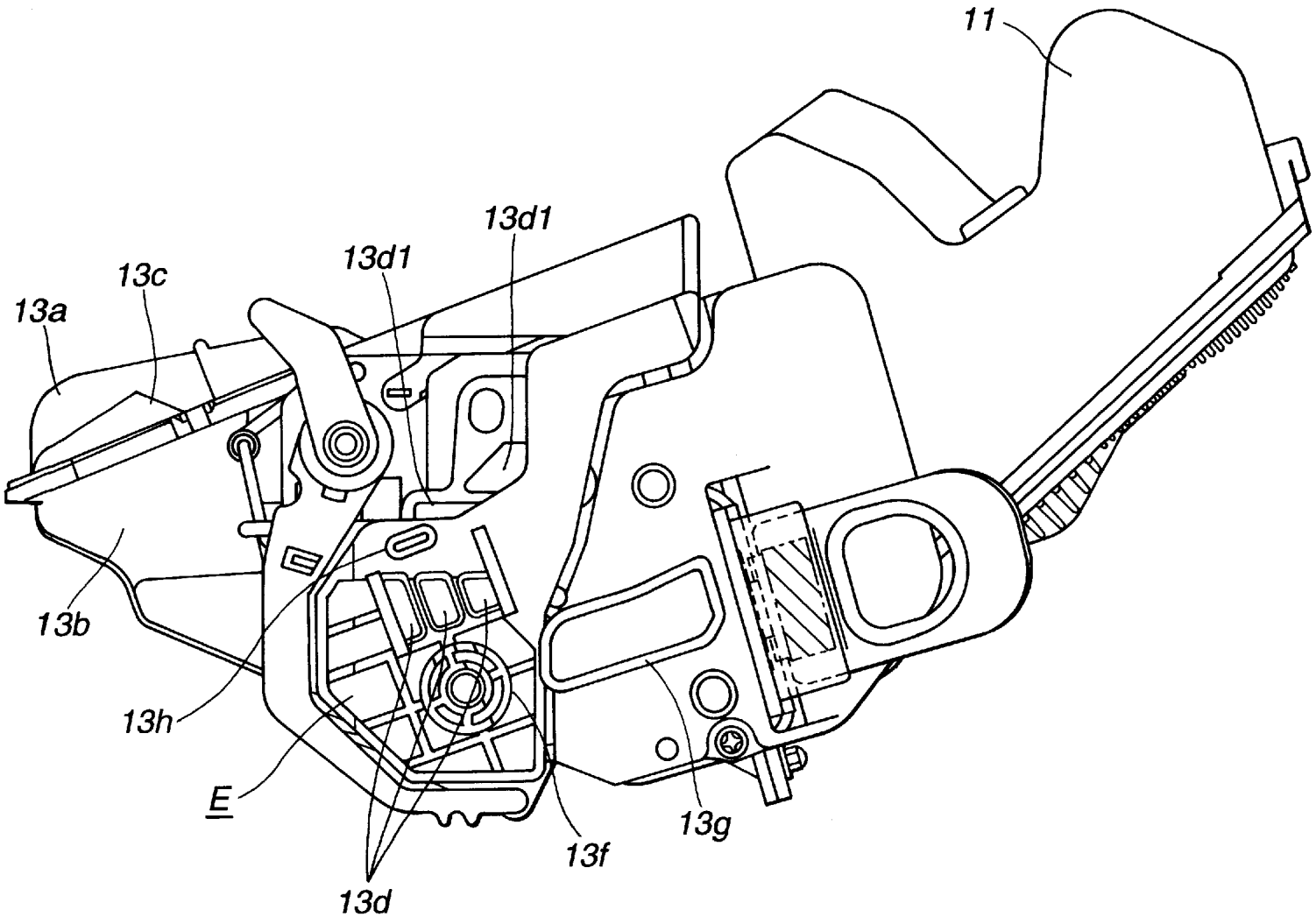
FIG. 5 is a left side view of the process cartridge shown in FIG. 3.
Figure 6:
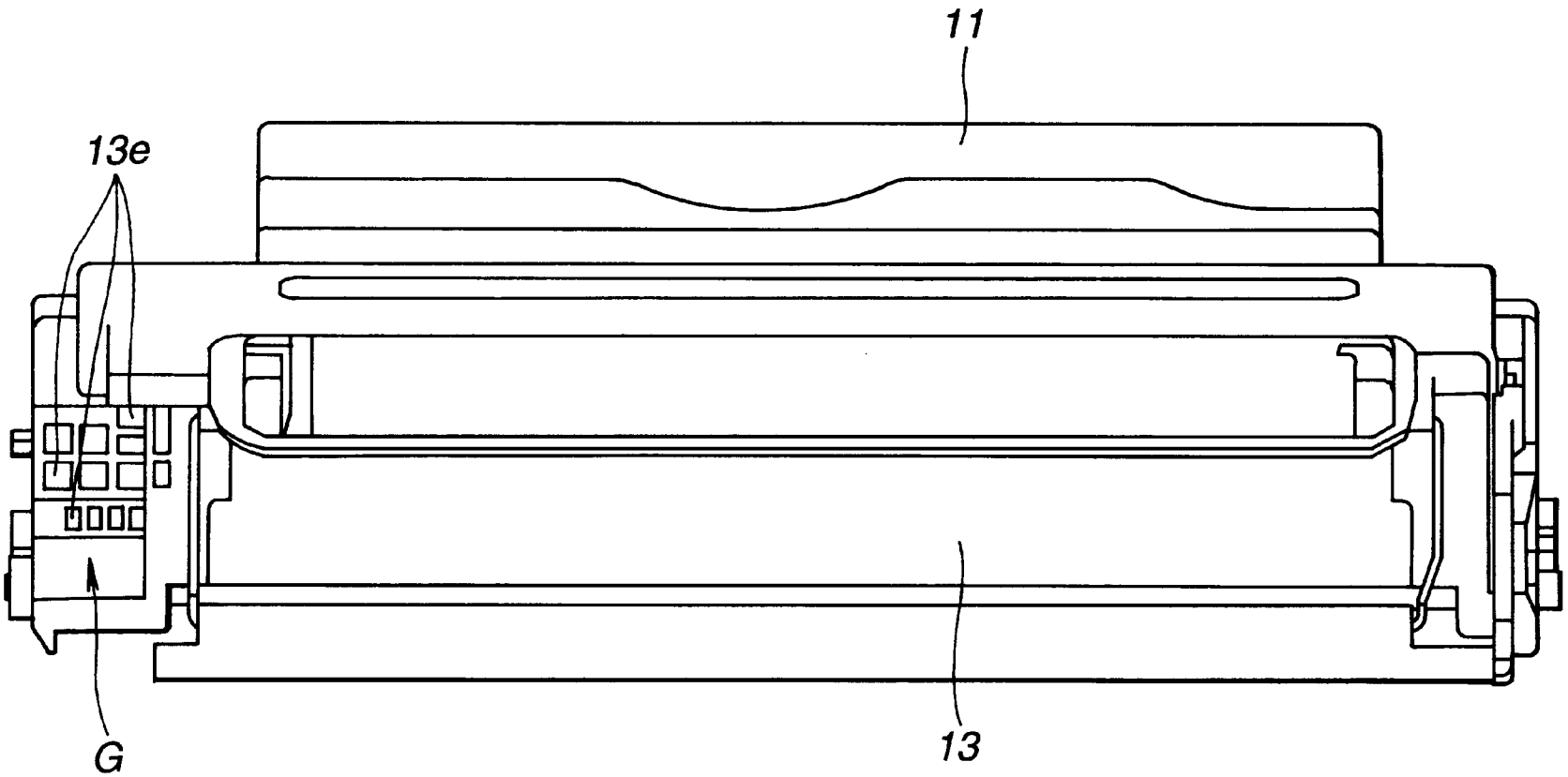
FIG. 6 is a front view of the process cartridge shown in FIG. 3.
Figure 7:
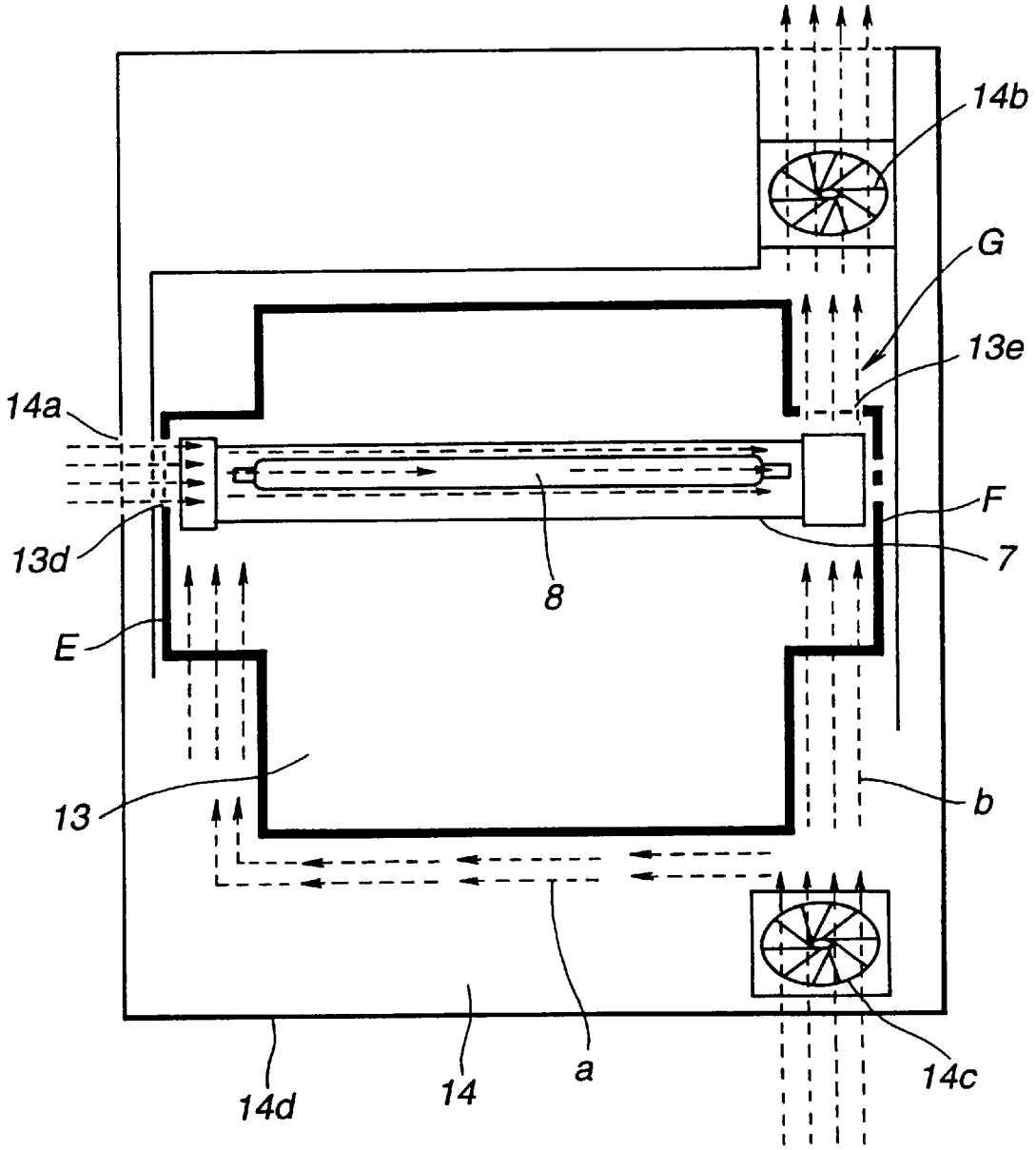
FIG. 7 is a horizontal cross-sectional view of the electrophotographic image forming apparatus shown in FIG. 1.

FIG. 1 is a diagram illustrating the configuration of an electrophotographic image forming apparatus (laser-beam printer) A according to the preferred embodiment. FIG. 2 is a perspective view illustrating an external appearance of the apparatus. FIGS. 3–7 are diagrams relating to the process cartridge B shown in FIG. 1; FIG. 3 is a side cross-sectional view of the process cartridge B; FIG. 4 is a schematic perspective view illustrating an external appearance of the process cartridge B; FIG. 5 is a right side view of the process cartridge B; FIG. 6 is a diagram illustrating the process cartridge B as seen from the front side; and FIG. 7 is a diagram schematically illustrating the flow of air in a state in which the process cartridge B is mounted in the main body 14 of the apparatus.

In the following description, the upper and lower surfaces of the process cartridge B indicate surfaces which are placed upward and downward, respectively, in a state in which the process cartridge B is mounted in the main body 14 of the apparatus.

Electrophotographic image forming apparatus A and process cartridge B

First, a description will be provided of the laser-beam printer A, serving as the electrophotographic image forming apparatus accoding to the preferred embodiment, with reference to FIGS. 1 and 2. FIG. 3 is a side cross-sectional view of the process cartridge B.

As shown in FIG. 1, the laser-beam printer A forms an image on a recording medium (such as recording paper, an OHP (overhead projector) sheet, a cloth or the like) according to an electrophotographic image forming process. A toner image is formed on a drum-shaped electrophotographic photosensitive member (hereinafter termed a "photosensitive drum"). More specifically, the photosensitive drum is charged by charging means, and then a latent image corresponding to image information is formed by projecting a laser beam corresponding to the image information onto the photosensitive drum from optical means. A toner image is formed by developing the latent image by developing means. In synchronization with the formation of the toner image, a recording medium 2 set within a sheet feeding cassette 3*a* is subjected to reversal conveyance by a pickup roller 3*b*, pairs of conveying rollers 3*c* and 3*d*, and a pair of registration rollers 3*e*. Then, the toner image formed on the photosensitive drum incorporated ion the process cartridge B is transferred onto the recording medium 2 by applying a voltage to a transfer roller 4, serving as transfer means. Then, the recording medium 2 having the toner image transferred thereto is conveyed to fixing means 5 by a conveying guide 3*f*. The fixing means 5 includes a driving roller 5*c*, and a fixing roller 5*b* incorporating a heater 5*a*, and fixes the transferred toner image by applying heat and pressure to the recording medium 2. The recording medium 2 is then conveyed by pairs of discharging rollers 3*g*, 3*h* and 3*i*, and is discharged onto a discharging tray 6 via a reversal path 3*j*. The discharging tray 6 is provided at an upper surface portion of the main body 14 of the image forming apparatus A. It is also possible to discharge the recording medium 2 by a pair of discharging rollers 3*m* by operating a swingable flapper 3*k*, without passing through the reversal path 3*j*. In the embodiment, the pickup roller 3*b*, the pairs of conveying rollers 3*c* and 3*d*, the pair of registration rollers 3*e*, the conveying guide 3*f*, the pairs of discharging rollers 3*g*, 3*h* and 3*i*, and the pair of discharging rollers 3*m* constitute conveying means 3.

As shown in FIGS. 3–7, in the process cartridge B, a photosensitive drum 7 having a photosensitive layer (not shown) is rotated, and the surface of the photosensitive drum 7 is uniformly charged by applying a voltage to a charging roller 8, serving as charging means. Then, a laser beam corresponding to image information from an optical system 1 is projected onto the photosensitive drum 7 via an exposure aperture 1*e*, to form a latent image. The latent image is developed by developing means 9 using toner. Namely, the charging roller 8 is provided in a state of contact with the photosensitive drum 7, and charges the photosensitive drum 7. The charging roller 8 is rotated by being driven by the photosensitive drum 7. The developing means 9 supplies a region to be developed of the photosensitive drum 7 with toner, and develops the latent image formed on the photosensitive drum 7. The optical system 1 includes a laser diode 1*a*, a polygonal mirror 1*b*, a lens 1*c* and a reflecting mirror 1*d*.

The developing means 9 feeds toner within a toner receptable 11A to a developing roller 9*c* by rotation of a toner feeding member 9*b*. The developing roller 9*c* incorporating a fixed magnet 9*g* is rotated, a toner layer having triboelectrified charges is formed on the surface of the developing roller 9*c* by a developing blade 9*d*, and the toner is supplied to the region to be developed of the photosensitive drum 7. By transferring the toner onto the photosensitive drum 7 in accordance with the latent image, a visualized toner image is formed. The developing blade 9*d* regulates the amount of toner on the circumferential surface of the developing roller 9*c*. Toner stirring members 9*e* and 9*f* for circulating the toner within a developing chamber are rotatably mounted near the developing roller 9*c*.

After transferring the toner image formed on the photosensitive drum 7 onto the recording medium 2 by applying a voltage whose polarity is opposite to that of the toner image, toner particles remaining on the photosensitive drum 7 are removed by cleaning means. The cleaning means 10 scrapes off toner particles remaining on the photosensitive drum 7 by means of an elastic cleaning blade 10*a* provided so as to contact the photosensitive drum 7, and collects the toner particles in a used-toner reservoir 10*b*.

The process cartridge B includes a toner frame 11 including the toner receptable (toner accommodating unit) 11A for accommodating toner, and a developing frame 12 for holding the developing means 9, including the developing roller 9*c* and the like, which are connected to each other. The process cartridge B is obtained by also connecting a cleaning frame 13, in which the photosensitive drum 7, the cleaning means 10 including the cleaning blade 10*a* and the like, and the charging roller 8 are mounted, to the combined block of the toner frame 11 and the developing frame 12. The process cartridge B is detachably mountable in the main body 14 of the apparatus by the operator.

An exposure aperture le for projecting light corresponding to image information onto the photosensitive drum 7, and a transfer aperture 13*n* for causing the photosensitive drum 7 to face the recording medium 2 are provided in the process cartridge B. More specifically, the exposure aperture le is provided on the cleaning frame 13, and the transfer aperture 13*n* is provided between the developing frame 12 and the cleaning frame 13.

Next, a description will be provided of the configuration of the housing of the process cartridge B of the embodiment.

The process cartridge B of the embodiment is in the form of a cartridge whose housing obtained by connecting the toner frame 11 and the developing frame 12 to each other and rotatably connecting the cleaning frame 13 to the combined block of the toner frame 11 and the developing frame 12 incorporates the photosensitive drum 7, the charging roller 8, the developing means 9, the cleaning means 10 and the like. The process cartridge B is detachably mounted in cartridge mounting means provided in the main body 14 of the apparatus.

Configuration of the housing of the process cartridge B

As described above, the process cartridge B of the embodiment has the housing obtained by connecting the toner frame 11, the developing frame 12 and the cleaning frame 13. The configuration of the housing will now be described.

As shown in FIG. 3, the toner feeding member 9*b* is rotatably mounted on the toner frame 11. The developing roller 9*c* and the developing blade 9*d* are mounted on the developing frame 12, and the stirring members 9*e* and 9*f* for circulating toner within the developing chamber are rotatably mounted near the developing roller 9*c*. An antenna bar 9*h* is mounted substantially in parallel with the developing frame 9*c* so as to face the developing roller 9*c* in the longitudinal direction. A developing unit D, serving as an integrated second frame, is provided by welding the toner frame 11 and the developing frame 12 to each other (according to ultrasonic welding in the embodiment).

A main frame 13*b* and a lid 13*a* of the cleaning frame 13 are welded to each other, to provide a receptacle, serving as the used-toner reservoir 10*b*. The photosensitive drum 7 is rotatably supported on portions protruded from both sides of the main frame 13*b* in the longitudinal direction toward the developing means 9. A hanging wall 21 is provided on the main frame 13*b* toward the photosensitive drum 7. A cleaning plate 10*c* is fixed on the hanging wall 21. An elastic cleaning blade 10*a* fixed on the cleaning plate 10*c* is in presssure contact with the photosensitive drum 7. A scooping sheet fixed on the main frame 13*b* contacts the photosensitive drum 7 at a position below the elastic cleaning blade 10*a*, so that the used-toner reservoir 10*b* of the cleaning frame 13 is sealed tightly. Namely, the front side, facing the developing means 9, of the used-toner reservoir 10*b* of the cleaning frame 13, is opened.

A frame wall 12*a* having a rib is provided at a portion of the developing frame 12 facing the cleaning frame 13, and a plate 9*d*1, on which the developing blade 9*d* is fixed, is fixed on the frame wall 12*a*.

Arm portions 19 provided at both sides of the developing frame 12 in the longitudinal direction protrude in recesses provided at both sides of the cleaning frame 13 in the longitudinal direction. The developing frame 12 is rotatably connected to the cleaning frame 13 by means of a connection pin 20 threaded through the arm portions 19. Alternatively, projections protruding in the longitudinal direction may be provided at the respective distal ends of the arm portions, and connection members (not shown) may be provided so as to grasp the projections. Compression springs 22*a* are inserted between the roots of the respective arm portions 19 and the main frame 13*b*, in order to provide a moment to press the photosensitive drum 7 and the developing roller 9*c* around the connection pin 20.

According to the above-described configuration, a cylindrical space S which is long in the longitudinal direction and has a cross section surrounded by an upper wall 13*b*1 of the main frame 13*b*, the hanging wall 21, the cleaning plate 10*c* and the elastic cleaning blade 10*a* of the cleaning frame 13, the photosensitive drum 7, the developing roller 9*c*, the developing blade 9*d*, the plate 9*d*1 and the frame wall 12*a*, and whose end portions in the longitudinal direction are provided by overlap of two side walls of the developing frame 12 within two side walls of the cleaning frame 13.

Process-cartridge mounting means

As shown in FIGS. 4 and 5, positioning bosses 13*f* protrude toward the outside in the longitudinal direction on the axis of the photsensitive drum 7 at both sides of the process cartridge B in the longitudinal direction. A posture determining rib 13*g* is provided behind each of the positioning bosses 13*f* in the mounting direction of the process cartridge B. A posture determining rib 13*h* is also provided above each of the positioning bosses 13*f*.

Figure 8:
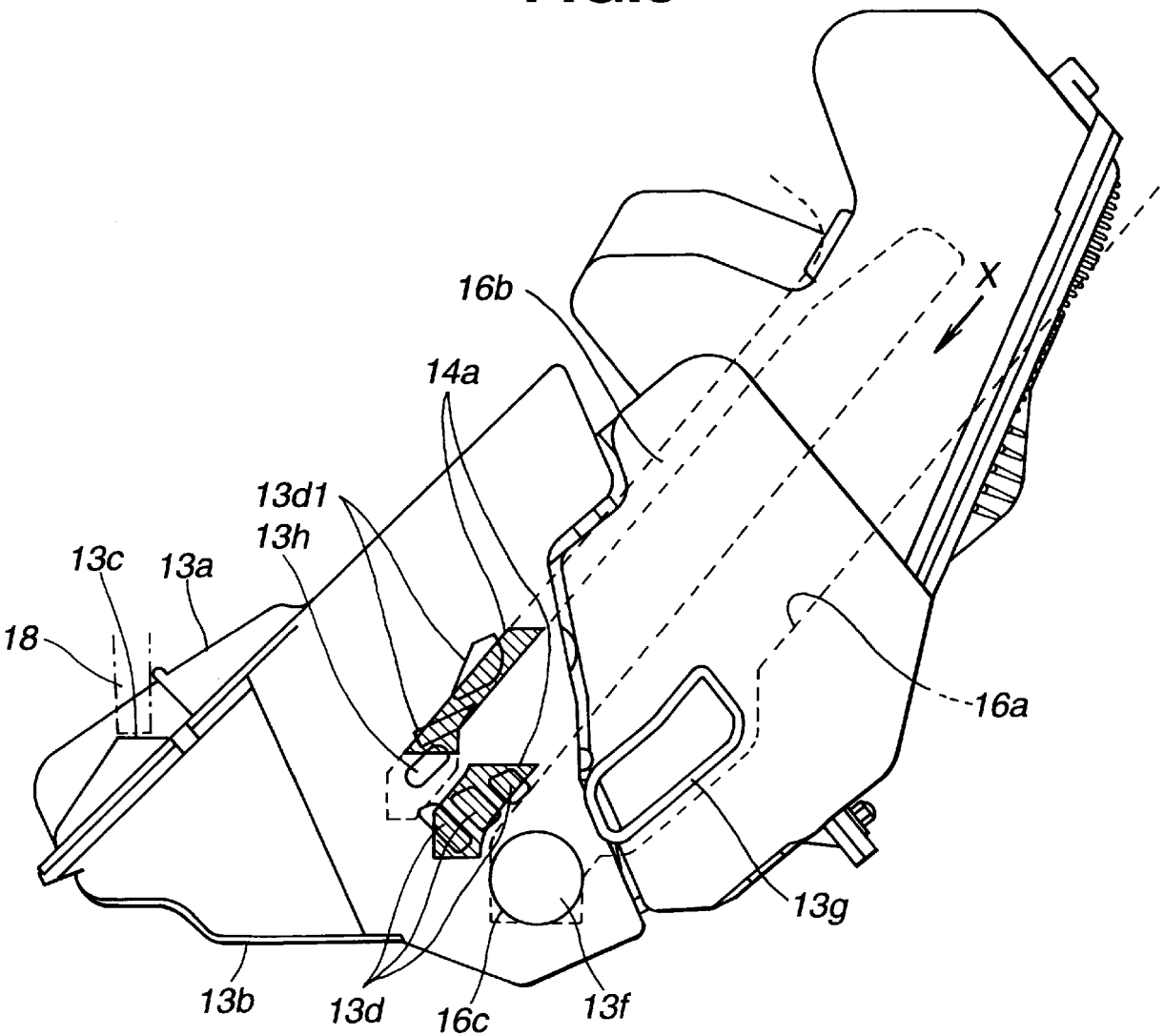
FIG. 8 is a diagram illustrating the positional relationship between left-side holes in the process cartridge shown in FIG. 3 and holes in the image forming apparatus.

In FIG. 1 , when an opening/closing member 35 is raised around a hinge 35*a*, a cartridge mounting space within the main body 14 of the image forming apparatus can be seen. As shown in FIG. 8, groove-shaped guide rails 16*a* and 16*b* are provided at each of two inner walls of the process cartridge B in the longitudinal direction in this space. The process cartridge B is inserted in a direction X while the positioning bosses 13*f* and the positioning ribs 13*g* are guided by the guide rails 16*a*, and the positioning bosses 13*h* are guided by the guide rails 16*b*. The position of the process cartridge B is determined by fitting of the positioning bosses 13*f* into positioning grooves 16*c* provided at the respective ends of the guide rails 16*a*. The process cartridge B receives a moment for rotating around the positioning bosses 13*f* due to the difference in the primary moment of the process cartridge B before and behind the positioning bosses 13*f*. As a result, a contact portion 13*c* of the process cartridge B contacts a contact member 18 of the main body 14 of the apparatus, to determine the posture of the process cartridge B.

Configuration of the cleaning unit

The cleaning frame 13 of a cleaning unit C includes two frames, i.e., a cleaning frame lid 13*a* which covers the used-toner reservoir 10*b* and includes the contact portion 13*c* for contacting the main body 14 of the apparatus, and a cleaning main frame 13*b* having other cleaning means. These two frames are connected to each other according to ultrasonic welding or the like.

As shown in FIG. 5, a plurality of threaded holes 13*d* are provided at sides E of the cleaning frame 13 so as to be threaded through the cleaning frame 13 at positions where the photosensitive drum 7 contacts the charging roller 8. The cross-sectional positions of threaded holes 13*d* coincide with the contact portion between the charging roller 8 and the photosensitive drum 7 shown in FIG. 3, so that external air can easily flow into the contact portion between the charging roller 8 and the photosensitive drum 7. In addition to the threaded holes 13*d*, two threaded holes 13*d*1 threaded above the charging roller 8 are also provided at the sides E. The threaded holes 13*d*1 are present above the threaded holes 13*d*. As shown in FIG. 7, intake holes 14*a* capable of introducing external air are provided in the main body 14 of the apparatus at positions facing the threaded holes 13*d*. The intake holes 14*a* are provided in a wall 14*d*, serving as a frame enclosing the main body 14 of the apparatus. Although schematically illustrated in FIG. 7, the positions of the intake holes are shifted from the positions of the threaded holes 13*d* so that external light does not directly enter the process cartridge B. As shown in FIG. 3, a space surrounded by the cleaning plate 10*c* and the developing blade plate 9*d*1 within the process cartridge B operates as a wind tunnel, so that air flows along the photosensitive drum 7 and the charging roller 8.

Figure 9:
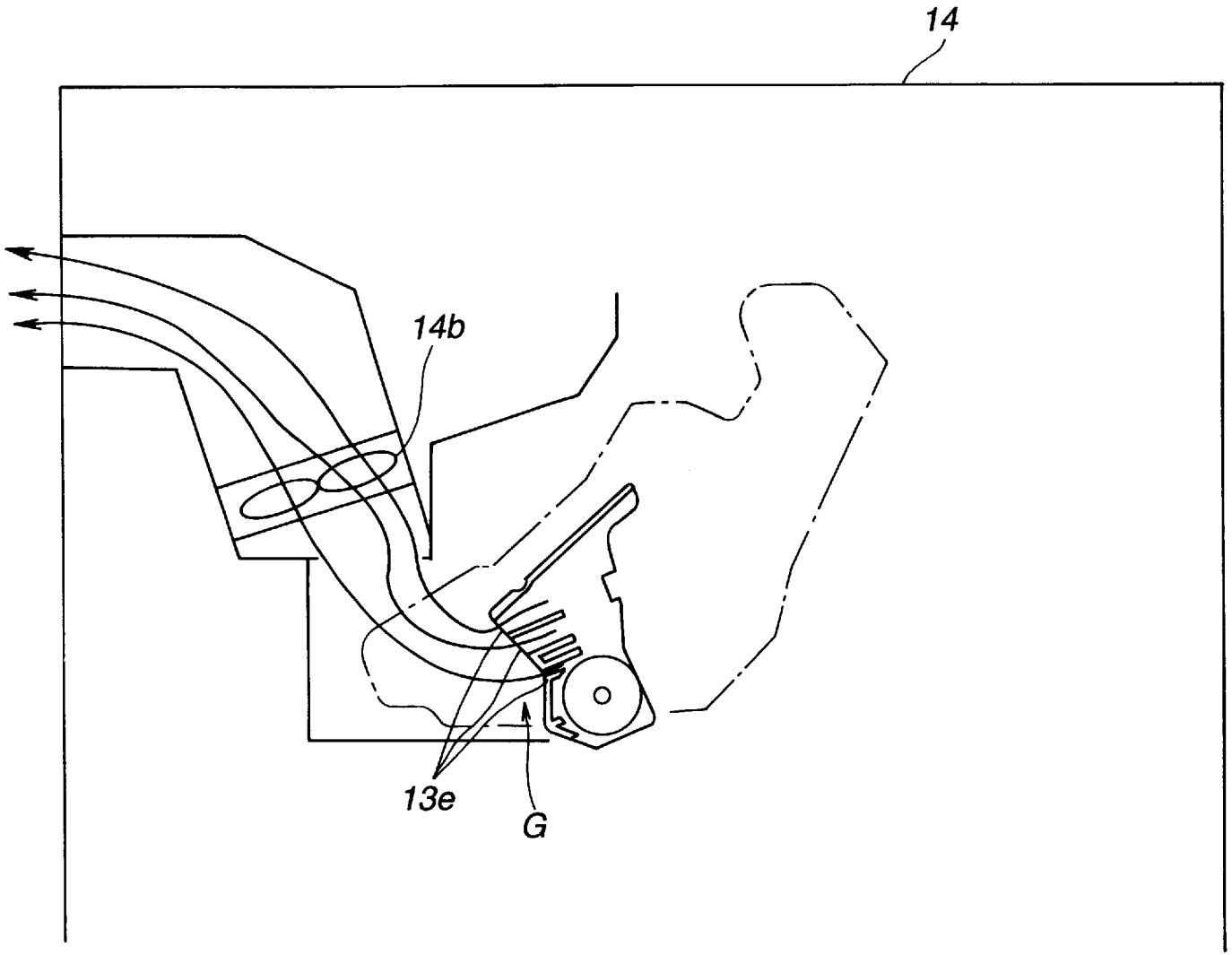
FIG. 9 is a diagram illustrating a manner in which air flows from within the process cartridge shown in FIG. 3 via a fan of the image forming apparatus.

A plurality of threaded holes 13*e* are also provided at a front surface G (see FIG. 9) orthogonal with respect to a side F of the cleaning frame 13 opposite to the side E in the longitudinal direction, and an exhaust fan 14*b* is provided at an opening threaded through the main body 14 of the image forming apparatus so as to face the threaded holes 13*e*, in order to exhaust the heat around the charging roller 8 within the cleaning frame 13.

As shown in FIG. 7, in addition to the above-described means for ventilating air in the process cartridge B, an intake fan 14*c* for introducing external air into the main body 14 of the image forming apparatus is provided at a portion upstream from the exhaust fan 14*b* in the conveying direction of the recording medium 2. The air taken in by the intake fan 14*c* is divided into an air flow "a" flowing along the left side of the process cartridge B as seen from the mounting direction of the process cartridge B in the cartridge mounting space, and an air flow "b" passing through a space at a right portion of the process cartridge B. These air flows "a" and "b" thereafter join a sucked flow by the discharge fan 14*b*. The air flows "a" and "b" passing through the left and right spaces along the process cartridge B then pass through a space between the optical case of the optical system 1 and the process cartridge B (see FIG. 1).

The above-described front surface G side has a negative pressure because the exhaust fun 14*b* sucks the air near the front surface G. External air is taken in from the intake holes 14*a* of the main body 14 of the apparatus, enters the process cartridge B passing through the threaded holes 13*d*, flows along the charging roller 8 while carrying ozone, leaves the process cartridge B after passing through the threaded holes 13*e*, and is exhausted t.o the outside of the main body 14 of the apparatus by the exhaust fan 14*b*.

According to the above-described configuration, air flows near the electrophotographic photosensitive member and the charging means, to discharge heat accumulated near the electrophotographic photosensitive member and within the process cartridge, and to prevent deformation of the frames and the adverse influence of the heat on toner and the respective process means.

Although in the embodiment, a roller electrode has been illustrated as charging means, a contact-type electrode, such as a brush roller, a blade, a brush or the like, may also be used as charging means. Since such an electrode contacts the photosensitive member, the contact portion operates as a guide for an air flow, thereby allowing a smooth air flow and improving the exhaust effect within the cartridge.

It is considered to be most preferable to provide holes for taking in and exhausting an air flow at positions corresponding to a contact portion between the charging means and the photosensitive member. However, it is possible to obtain a sufficient exhaust effect even if the positions of the holes do not coincide with the contact portion between the charging means and the photosensitive member as in the embodiment. The effects of the invention may also be achieved not only when the positions of the intake holes coincide with the contact portion, but also when only the positions of the exhaust holes coincide with the contact portion, when the positions of both the intake and exhaust holes coincide with the contact portion, or when the positions of both the intake and exhaust holes do not coincide with the contact portion.

The individual components shown in outline in the drawings are all well known in the process cartridge and image forming apparatus arts and their specific construction and operation are not critical to the operation or the best mode for carrying out the invention.

While the present invention has been described with respect to what is considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process cartridge detachably mountable in a main body of an image forming apparatus, said process cartridge comprising:

an electrophotographic photosensitive member;

a charging member for charging said electrophotographic photosensitive member, wherein said charging member is provided along a longitudinal direction of said electrophotographic photosensitive member;

a frame for supporting said electrophotographic photosensitive member and said charging member;

a plurality of first holes for taking in air, provided at one end portion of said frame in the longitudinal direction and opened at a position near one end portion of said charging member in the longitudinal direction; and means for preventing deformation of said frame due to the heat accumulating near said electrophotographic photosensitive member comprising: a plurality of second holes for discharging sufficient heat accumulated at a surrounding portion of the electrophotographic photosensitive member to prevent deformation of said frame, said plurality of second holes being provided at another end portion of said frame in the longitudinal direction and opened at a position near another end portion of said charging member in the longitudinal direction.

2. A process cartridge according to claim 1, wherein said first holes for taking in air and said second holes for exhausting air are provided at positions overlapped with a contact portion between said charging member and said electrophotographic photosensitive member, as seen from the longitudinal direction of said charging member.

3. A process cartridge according to claim 1, wherein said first holes for taking in air and said second holes for exhausting air are provided at positions not overlapped with a contact portion between said charging member and said electrophotographic photosensitive member, as seen from the longitudinal direction of said charging member.

4. A process cartridge according to claim 1, wherein said charging member comprises an electrode contacting said photosensitive member.

5. A process cartridge detachably mountable in a main body of an image forming apparatus, said process cartridge comprising:

an electrophotographic photosensitive member;

a charging member for charging said electrophotographic photosensitive member, wherein said charging member is provided along a longitudinal direction of said electrophotographic photosensitive member; and a frame for supporting said electrophotographic photosensitive member and said charging member;

wherein one longitudinal end portion of said frame has a plurality of first holes therein, the plurality of first holes facing a direction substantially orthogonal to the longitudinal direction of said charging member to permit air to flow from the outside, through the plurality of first holes in the longitudinal direction of said charging member; and wherein the other longitudinal end portion of said frame has a plurality of second holes therein, the plurality of second holes facing the longitudinal direction of said charging member to permit air to flow from the inside to the outside of said process cartridge, through the plurality of second holes in a direction substantially orthogonal to the longitudinal direction of said charging member.

6. A process cartridge according to claim 5, wherein said first holes for taking in air and said second holes for exhausting air are provided at positions overlapped with a contact portion between said charging member and said electrophotographic photosensitive member, as seen from the longitudinal direction of said charging member.

7. A process cartridge according to claim 5, wherein said first holes for taking in air and said second holes for exhausting air are provided at positions not overlapped with a contact portion between said charging member and said electrophotographic photosensitive member, as seen from the longitudinal direction of said charging member.

8. A process cartridge according to claim 5, wherein said charging member comprises an electrode contacting said photosensitive member.

9. A process cartridge detachably mountable in a main body of an image forming apparatus, said process cartridge comprising:

an electrophotographic photosensitive drum;

a charging roller for charging said electrophotographic photosensitive drum, wherein said charging roller contacts said electrophotographic photosensitive drum;

a developing roller for developing a latent image formed on said electrophotographic photosensitive drum using toner;

a cartridge frame comprising:

a first frame for supporting said electrophotographic photosensitive drum and said charging roller;

a second frame for supporting said developing roller; and an element rockably connecting said first and second frames;

a plurality of first holes for taking in air, provided at one end portion of said cartridge frame in the longitudinal direction and opened at a position near one end portion of said charging roller in the longitudinal direction; and a plurality of second holes for discharging heat accumulated at a surrounding portion of the electrophotographic photosensitive drum, provided at another end portion of said cartridge frame in the longitudinal direction and opened at a position near another end portion of said charging roller in the longitudinal direction.

10. A process cartridge according to claim 9, wherein said charging roller comprises an electrode contacting said photosensitive drum.

11. A process cartridge according to claim 9, wherein said first frame for holding said electrophotographic photosensitive drum and said charging roller comprises a supporting member for a cleaning member for removing toner particles remaining on said electrophotographic photosensitive drum, and a used-toner reservoir for accommodating the removed toner particles.

12. An electrophotographic image forming apparatus, capable of detachably mounting a process cartridge, for forming an image on a recording medium, said apparatus comprising:

(a) a mounting member capable of removably mounting a process cartridge comprising an electrophotographic photosensitive member, a charging member for charging said electrophotographic photosensitive member, wherein said charging member is provided along a longitudinal direction of said electrophotographic photosensitive member, a frame for supporting said electrophotographic photosensitive member and said charging member, a plurality of first holes for taking in air, provided at one end portion of said frame in the longitudinal direction and opened at a position near one end portion of said charging member in the longitudinal direction, and means for preventing deformation of said frame due to the heat accumulating near said electrophotographic photosensitive member, comprising a plurality of second holes for discharging sufficient heat accumulated at a surrounding portion of the electrophotographic photosensitive member to prevent deformation of the frame, said plurality of second holes being provided at another end portion of said frame in the longitudinal direction and opened at a position near another end portion of said charging member in the longitudinal direction;

(b) intake holes, communicating with said first holes, provided at an outer frame of a main body of said image forming apparatus facing said first holes of said process cartridge, in a state in which said process cartridge is mounted in the main body of said image forming apparatus;

(c) discharge means for discharging air within the main body of said image forming apparatus communicating with said second holes of said process cartridge to the outside of said apparatus, in a state in which said process cartridge is mounted in the main body of said image forming apparatus; and (d) conveyance means for conveying said recording medium.

13. An apparatus according to claim 12, wherein said charging member comprises an electrode contacting said photosensitive member.

14. An apparatus according to claim 12, wherein said frame for holding said electrophotographic photosensitive member and said charging member comprises a supporting member for a cleaning member for removing toner particles remaining on said electrophotographic photosensitive member, and a used-toner reservoir for accommodating the removed toner particles.

15. An electrophotographic image forming apparatus, capable of detachably mounting a process cartridge, for forming an image on a recording medium, said apparatus comprising:

(a) a mounting member capable of removably mounting a process cartridge comprising an electrophotographic photosensitive member, a charging member for charging said electrophotographic photosensitive member, wherein said charging member is provided along a longitudinal direction of said electrophotographic photosensitive member, a frame for supporting said electrophotographic photosensitive member and said charging member, wherein one longitudinal end portion of said frame has a plurality of first holes therein, the plurality of first holes facing a direction substantially orthogonal to the longitudinal direction of said charging member to permit air to flow from the outside, through the plurality of first holes in the longitudinal direction of said charging member, and wherein the other longitudinal end portion of said frame has a plurality of second holes therein, the plurality of second holes facing the longitudinal direction of said charging member to permit air to flow from the inside to the outside of said process cartridge, through the plurality of second holes in a direction substantially orthogonal to the longitudinal direction of said charging member;

(b) intake holes, communicating with said first holes, provided at an outer frame of a main body of said image forming apparatus facing said first holes of said process cartridge, in a state in which said process cartridge is mounted in the main body of said image forming apparatus;

(c) discharge means for discharging air within the main body of said image forming apparatus communicating with said second holes of said process cartridge to the outside of said apparatus, in a state in which said process cartridge is mounted in the main body of said image forming apparatus; and (d) conveyance means for conveying said recording medium.

16. An electrophotographic image forming apparatus, capable of detachably mounting a process cartridge, for forming an image on a recording medium, said apparatus comprising:

(a) a mounting member capable of removably mounting a process cartridge comprising an electrophotographic photosensitive drum, a charging roller for charging said electrophotographic photosensitive drum, wherein said charging roller contacts said electrophotographic photosensitive drum, a developing roller for developing a latent image formed on said electrophotographic photosensitive drum using toner; a cartridge frame comprising: (i) a first frame for supporting said electrophotographic photosensitive drum and said charging roller; (ii) a second frame for supporting said developing roller; and (iii) an element rockably connecting said first and second frames, a plurality of first holes for taking in air, provided at one end portion of said cartridge frame in the longitudinal direction and opened at a position near one end portion of said charging roller in the longitudinal direction, and a plurality of second holes for discharging heat accumulated at a surrounding portion of the electrophotographic photosensitive drum, provided at another end portion of said cartridge frame in the longitudinal direction and opened at a portion near another end position of said charging roller in the longitudinal direction;

(b) intake holes, communicating with said first holes, provided at an outer frame of a main body of said image forming apparatus facing said first holes of said process cartridge, in a state in which said process cartridge is mounted in the main body of said image forming apparatus;

(c) discharge means for discharging air within the main body of said image forming apparatus communicating with said second holes of said process cartridge to the outside of said apparatus, in a state in which said process cartridge is mounted in the main body of said image forming apparatus; and (d) conveyance means for conveying said recording medium.

17. An apparatus according to claim 16, wherein said first frame for holding said electrophotographic photosensitive drum and said charging roller comprises a supporting member for a cleaning member for removing toner particles remaining on said electrophotographic photosensitive drum, and a used-toner reservoir for accommodating the removed toner particles.

* * * * *

UNITED STATES PATENT AND TRADEMARK OFFICE

CERTIFICATE OF CORRECTION

PATENT NO. : 6,219,504 B1
DATED : April 17, 2001
INVENTOR(S) : Hiroomi Matsuzaki et al.

It is certified that error appears in the above-identified patent and that said Letters Patent is hereby corrected as shown below:

Column 1,
Line 9, "electrophographic" should read -- electrophotographic --.
Line 10, "medium" should read -- medium using an --.
Line 28, "moutable" should read -- mountable --.

Column 4,
Line 26, "respect" should read -- respect to --.
Line 58, "accoding" should read -- according --.

Column 7,
Line 36, "photsensitive" should read -- photosensitive --.

Signed and Sealed this

Twenty-second Day of January, 2002

*Attest:*

*Attesting Officer*

JAMES E. ROGAN
*Director of the United States Patent and Trademark Office*